US008888146B2

(12) United States Patent
Taylor et al.

(10) Patent No.: US 8,888,146 B2
(45) Date of Patent: Nov. 18, 2014

(54) SECURITY DEVICE FOR A SLIDING DOOR OR SLIDING WINDOW ASSEMBLY

(76) Inventors: Joseph Curtis Taylor, Birch Run, MI (US); Jack Roy Taylor, Clio, MI (US)

( * ) Notice: Subject to any disclaimer, the term of this patent is extended or adjusted under 35 U.S.C. 154(b) by 234 days.

(21) Appl. No.: 13/363,106

(22) Filed: Jan. 31, 2012

(65) Prior Publication Data

US 2013/0193695 A1 Aug. 1, 2013

(51) Int. Cl.
*E05C 19/00* (2006.01)

(52) U.S. Cl.
USPC ..... 292/1; 292/DIG. 15; 292/DIG. 46

(58) Field of Classification Search
USPC ..... 292/1, 137, 138, 259 R, 288, 289, 292/DIG. 15, DIG. 46
See application file for complete search history.

(56) References Cited

U.S. PATENT DOCUMENTS

| | | | | | |
|---|---|---|---|---|---|
| 2,264,962 | A | | 12/1941 | Adams | |
| 3,378,293 | A | * | 4/1968 | Silk | 292/202 |
| 3,661,413 | A | * | 5/1972 | Silva | 292/238 |
| 3,768,847 | A | | 10/1973 | Buck, Jr. et al. | |
| 4,017,105 | A | | 4/1977 | Paxton | |
| 4,208,841 | A | | 6/1980 | Starks | |
| 4,274,666 | A | | 6/1981 | Peck | |
| 4,303,265 | A | * | 12/1981 | Beard | 292/145 |
| 4,792,168 | A | | 12/1988 | Kardosh | |
| 4,822,084 | A | | 4/1989 | Fox | |
| 4,907,832 | A | | 3/1990 | Pemberton | |
| 4,932,694 | A | | 6/1990 | Cater, Sr. | |
| 5,203,596 | A | | 4/1993 | Stevens | |
| 5,209,018 | A | | 5/1993 | Heinrich | |
| 5,226,201 | A | * | 7/1993 | Lefebvre | 16/86 A |
| 5,454,610 | A | * | 10/1995 | Taylor et al. | 292/339 |
| 5,645,304 | A | * | 7/1997 | Richardson et al. | 292/1 |
| D384,875 | S | | 10/1997 | Sayler et al. | |
| D419,052 | S | | 1/2000 | Laporte et al. | |
| 6,167,655 | B1 | | 1/2001 | Santa Cruz et al. | |
| 6,382,689 | B1 | | 5/2002 | Brown | |
| 6,655,720 | B2 | | 12/2003 | Rampen | |
| D612,717 | S | * | 3/2010 | Frankel | D8/402 |
| 7,731,252 | B1 | | 6/2010 | Stewart | |
| 8,096,593 | B2 | | 1/2012 | Gibbons | |
| 2011/0011137 | A1 | * | 1/2011 | Frankel | 70/93 |

* cited by examiner

*Primary Examiner* — Kristina Fulton
*Assistant Examiner* — Christine M Mills
(74) *Attorney, Agent, or Firm* — Harness, Dickey & Pierce, P.L.C.

(57) ABSTRACT

A security device for a sliding door or sliding window assembly comprising a base plate and a removably interlocking stop member. The base plate is securely fastened to the floor or window sill, respectively, in close proximity and along the path of movement of a sliding door or sliding window, by means of a plurality of openings for receiving screws. The stop member, while engagingly disposed in the interlocked, in use position, prevents the sliding door or sliding window from opening at all or past a predetermined point. The base plate and stop member are each formed having an interlocking means element, adapted to receive, matingly, the others interlocking means element. The stop member features a blocking element, which projects into the path of the sliding door or sliding window, while in the in use position. Removing the stop member allows normal movement of the sliding door or sliding window.

9 Claims, 2 Drawing Sheets

SECURITY DEVICE FOR A SLIDING DOOR OR SLIDING WINDOW ASSEMBLY

BACKGROUND OF THE INVENTION

The present invention is a security device for use with sliding doors, sliding windows, sliding panels, sliding patio doors, and the like, to prevent entry from the outside when desired.

There exists a number of different types of security devices configured to block a sliding door or sliding window from opening. For example, there exists numerous devices that mounts directly to the sliding door or sliding window assembly, near it's upper or lower framing track allowing the user to engage a plunger style pin into a hole in the framing track to prevent the door or window from opening. Further there exists other devises designed to be mounted to the sliding door or sliding window assembly, which comprise pivoting or adjustable parts which brace or block the sliding panel in the closed position. This requires attaching these devices directly to the sliding door or sliding window panel or assembly as well as any other necessary alterations made to the door or window assembly for such installations, which may alter or diminish the structural integrity of the assembly or affected parts of the assembly. Further, there exists portable brace devices which are designed to be placed and adjusted to fit between the sliding door or sliding window panel and it's vertical framing track, bracing them apart, securing the unit closed. These portable security devices are often cumbersome and awkward to install or adjust each time they are used. Furthermore these portable devices require uninstallation or adjustment and storage when not in use. These portable security devices often are comprised of a substantial number of parts, which may increase the likelihood of failure, and increased cost of manufacturing.

There exists a need for an improved sliding door and sliding window security devise which is not directly attached to the sliding door or sliding window assembly, is not portable or in need of adjustment, is simple and easy to install, is simple and easy to use, and can be manufactured more economically with fewer parts.

Further, it is desirable that such a devise may be installed adjacent to the sliding door or sliding window assembly, securely fastened to the floor, in relation to a sliding door, or the window sill, in relation to a sliding window, using the strength and holding power of the mounting surface to maintain the sliding door or sliding window in a closed position, or from passing a predetermined point along it's opening path of movement.

SUMMARY OF THE INVENTION

The present invention can be summarized as a two piece security device for sliding doors and sliding windows, comprised of a base plate and a removably interlocking stop member, where as the base plate is securely fastened to the floor in relation to a sliding door, or the window sill in relation to a sliding window, and the removably interlocking stop member can be engagingly disposed to the base plate, in a blocking position, projecting into the path of movement of the sliding door or sliding window, preventing it from opening at all or past a predetermined point.

It is the principle object of the present invention to provide a security device for a sliding door or sliding window assembly that is permanently installed adjacent to the sliding door or sliding window assembly, securely fastened to the floor in relation to a sliding door or the window sill in relation to a sliding window, using the strength and holding power of the mounting surface to maintain the sliding door or sliding window in a closed position, or from passing a predetermined point along it's opening path of movement.

It is another object of the present invention to provide a security device for a sliding door or sliding window assembly which is not directly attached to the sliding door or sliding window assembly.

It is yet another object of the present invention to provide a security device for a sliding door or sliding window assembly which is not portable or in need of installation adjustment An additional object of the present invention is to provide a security device for a sliding door or sliding window assembly that is simple and easy to install.

A further object of the present invention is to provide a security device for a sliding door or sliding window assembly that is simple and easy to use.

A still further object of the present invention is to provide a security device for a sliding door or sliding window assembly, with few parts, making it economical to manufacture.

These and other objects of the present invention shall become apparent upon further review of the following specification and drawings.

DETAILED DESCRIPTION OF THE INVENTION

Figure 1:
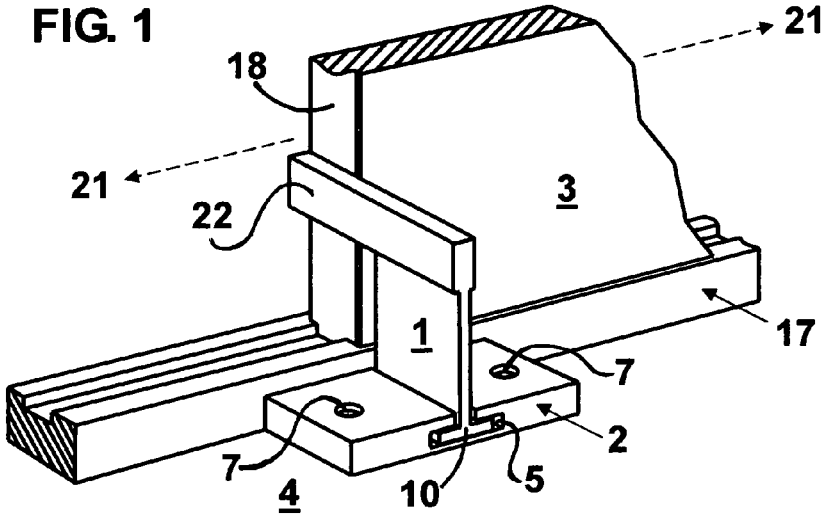
FIG. 1 is a perspective view of the first preferred embodiment of the invention, securely fastened to the mounting surface, being used with a sliding door or sliding window, in the in use, blocking position.
Figure 2:
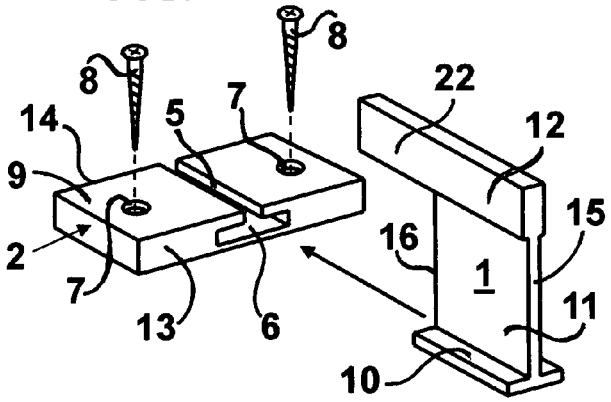
FIG. 2 is an exploded perspective view of the first preferred embodiment of the invention, in an unengaged, non use position.
Figure 3:
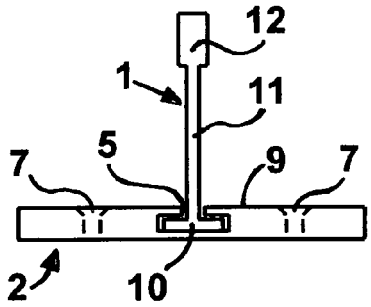
FIG. 3 is an end view of the first preferred embodiment of the invention, in the engaged, in use position.
Figure 4:
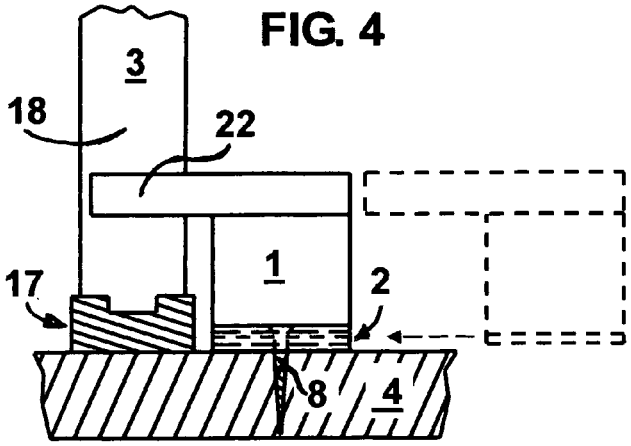
FIG. 4 is a side view of the first preferred embodiment of the invention, securely fastened to the mounting surface, in the in use, blocking position.
Figure 5:
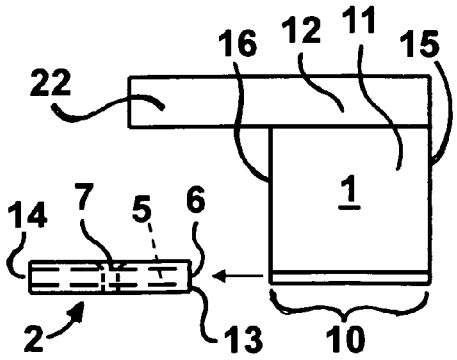
FIG. 5 is an exploded side view of the first preferred embodiment of the invention, in an unengaged, non use position.

Referring to the drawings, FIGS. 1-10, of the present invention, wherein the same or generally similar features share common reference numerals. The numeral 3 indicates generally a sliding panel, of a sliding door or sliding window assembly, shown only partially and in the closed position, while the numeral 17 indicates generally the lower frame track of a sliding door or sliding window assembly, on or in which said sliding panel 3 moves horizontally back and forth, while the numeral 4 indicates generally the mounting surface to which the invention is affixed.

Figure 6:
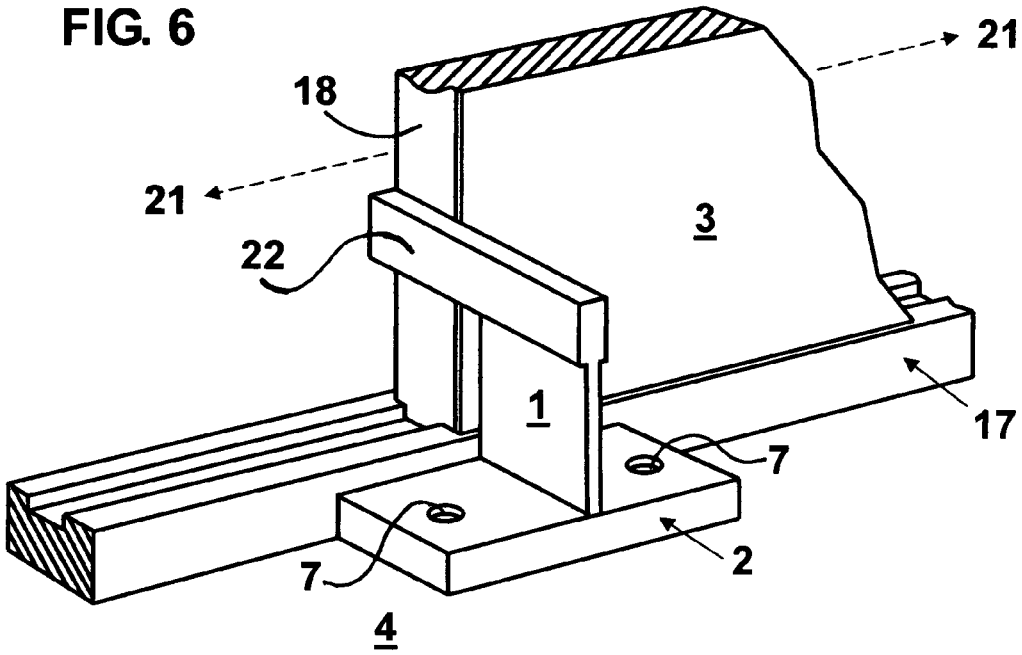
FIG. 6 is a perspective view of the second preferred embodiment of the invention, securely fastened to the mounting surface, being used with a sliding door or sliding window, in the in use, blocking position.
Figure 7:
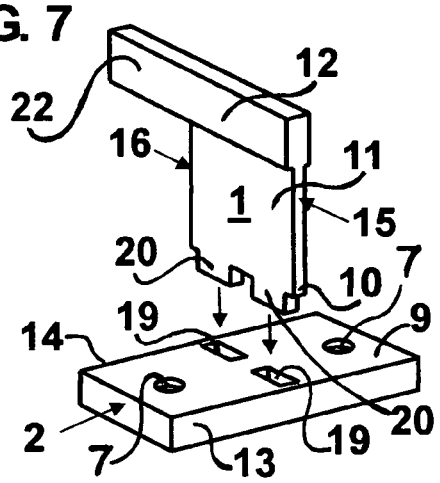
FIG. 7 is an exploded perspective view of the second preferred embodiment of the invention, in an unengaged, non use position.
Figure 8:
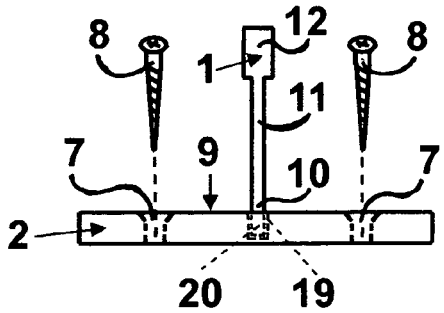
FIG. 8 is an end view of the second preferred embodiment of the invention, in the engaged, in use position.
Figure 9:
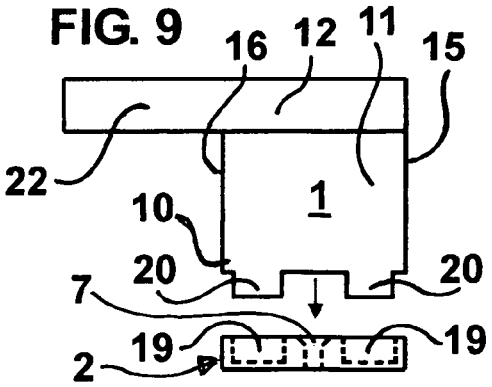
FIG. 9 is an exploded side view of the second preferred embodiment of the invention, in an unengaged, non use position.
Figure 10:
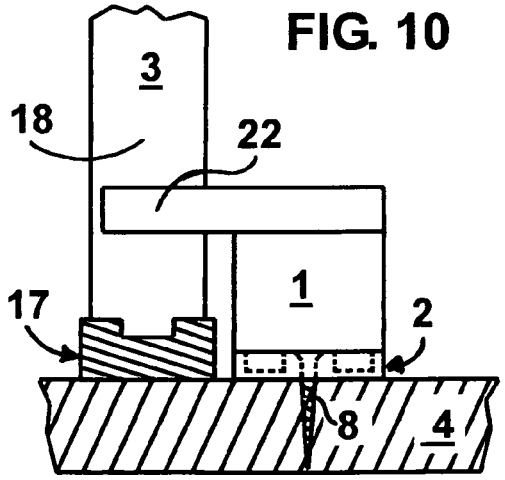
FIG. 10 is a side view of the second preferred embodiment of the invention, securely fastened to the mounting surface, in the in use, blocking position.

The sliding door and sliding window security devise shown in FIGS. 1-10 of the drawing sheets, consists of a removably interlocking stop member 1 and a base plate 2, each made of metal or other materials with good strength characteristics. While interlockingly engaged, in the in use position, as shown in FIG. 1 and FIG. 6, the removably interlocking stop member 1 will project into the path of movement 21 of the sliding panel 3, blocking it from moving at all or past a predetermined point, depending on the placement of the base plate 2, which is securely fastened to the mounting surface 4, adjacent to and along the path of movement 21, of the sliding panel 3.

In a first preferred embodiment, shown in FIGS. 1-5, the base plate 2 is characterized as a flat anchor plate, having a plurality of openings 7 for receiving screws 8, which securely fasten the base plate 2 to the mounting surface 4, with the mounting surface 4 being the floor in relation to a sliding door or the window sill in relation to a sliding window, on a substantially similar longitudinal axis to the path of movement 21 of the sliding panel 3, adjacent to and in close proximity to the leading edge 18 of the sliding panel 3 of a sliding door or sliding window assembly in the closed position, wherein the base plate 2 is positioned such that the removably interlocking member 1, while engagingly disposed, projects into the path of movement 21 of the sliding panel 3 as closely as possible to the leading edge 18 of the sliding panel 3, in a blocking position, with the base plate 2 having a slot 5 of a predisposed shape, eg. T slot, formed into the base plate top 9 on a transverse longitudinal axis, perpendicular to the path of movement 21 of the sliding panel 3 and characterized as a recessed slot formed fully through base plate 2 from base plate front side 13 to base plate back side 14, with base plate back side 14 being in closest proximity to the sliding panel 3, with said slot 5 having a slot opening 6 on base plate front side 13, and an optional slot opening on base plate side 14 and adapted to receive, by insertion, the similarly shaped bottom 10 of the removably interlocking stop member 1, enabling insertion and interlocking engagement of the stop member 1 with the base plate 2. The arrangement is such that the stop member 1 is insertable and slidably movable through the slot 5 in a direction generally transverse of the base plate 2 and perpendicular to the path of movement of the sliding panel 3.

The removably interlocking stop member 1 is characterized as an upright removably interlocking stop member, oriented perpendicularly to and projecting into the path of movement 21 of the sliding panel 3 while engagingly disposed to the floor plate 2, in use position, and having a bottom 10, a middle 11, a top 12, a nose projection 22, a front edge 16, and a rear edge 15, with bottom 10 formed with a predisposed shape, eg. inverted T, linearly from front edge 16 to rear edge 15, adapted to be insertably engaged with the similarly shaped slot 5 of the base plate 2 at said slot opening 6, with middle 11 formed upwardly from bottom 10 to top 12, connectively and supportively, with top 12 facilitating handling and having said nose projection 22 extending from it's front edge 16, forwardly, providing a blocking element for contact with said leading edge 18 of sliding panel 3. The corresponding interlocking of the stop member 1 and the base plate 2 prevents the sliding panel 3 from moving at all or past a predetermined point.

In a second embodiment, shown in FIGS. 6-10, the base plate 2 is characterized as a flat anchor plate, having a plurality of openings 7 for receiving screws 8, which securely fasten the base plate 2 to the mounting surface 4, with the mounting surface 4 being the floor in relation to a sliding door or the window sill in relation to a sliding window, on a substantially similar longitudinal axis to the path of movement 21 of the sliding panel 3, adjacent to and in close proximity to the leading edge 18 of the sliding panel 3 of a sliding door or sliding window assembly in the closed position, wherein the base plate 2 is positioned such that the removably interlocking member 1, while engagingly disposed, projects into the path of movement 21 of the sliding panel 3 as closely as possible to the leading edge 18 of the sliding panel 3, in a blocking position, with the base plate 2 having one or more openings 19, of a predisposed shape and orientation, formed into the base plate top 9. The openings 19 are characterized as female openings and adapted to receive by insertion, similarly shaped and oriented projections 20, characterized as male projections, projecting downwardly from the underside of the bottom 10 of the removably interlocking stop member 1, enabling insertion and interlocking engagement of the removably interlocking stop member 1 with the base plate 2, matingly, with reasonably close tolerances to substantially inhibit rotational or lateral movement. The arrangement is such that the stop member 1 is insertable from above.

The removably interlocking stop member 1 is characterized as an upright removably interlocking stop member, oriented perpendicularly to and projecting into the path of movement of the sliding panel 3 while engagingly disposed in use position, having a bottom 10, a middle 11, a top 12, a nose projection 22, a front edge 16, and a rear edge 15, with bottom 10 formed with one or more projections 20, of a predisposed shape and orientation, projecting downwardly from it's underside and adapted to be insertably engaged with the similarly shaped and oriented openings 19 in the base plate top 9, and having middle 11 formed upwardly from bottom 10 to top 12, connectively and supportively, with top 12 facilitating handling and having said nose projection 22 extending from it's front edge 16, forwardly, providing a blocking element for contact with said leading edge 18 of sliding panel 3. It is evident that the interlocking of the stop member 1 and the base plate 2 prevents the sliding panel 3 from moving at all or past a predetermined point.

While the first preferred embodiment of the invention and a second embodiment of the invention have been described above, it will be recognized and understood that various modifications may be made in the invention and the appended claims are intended to cover all such modifications which fall within the spirit and scope of the invention.

What is claimed is:

1. A security device for preventing movement of a sliding door or a sliding window, the security device comprising:

a base plate configured to fixedly mount to a mounting surface, the base plate including a first edge and an oppositely located second edge, the base plate further including a slot having a T-shape, the T-shape of the slot extending through the first edge and through the oppositely located second edge along a first direction, the first direction being parallel to the mounting surface when said base plate is fixedly mounted to the mounting surface; and a stop member including a first leg and a second leg, the first leg extending upwardly along a second direction that is angularly oriented with respect to the first direction and having a mating feature defining a T-feature configured to slidably engage the slot of the base plate along the first direction such that the first leg does not extend beyond the base plate in the first direction, the second leg defining a cantilever and extending from the first leg along the first direction, the second leg configured to rigidly engage the sliding door or the sliding window and blocking the sliding door or the sliding window from sliding along a third direction when the mating feature of the first leg slidably engages the slot of the base plate.

2. The security device of claim 1, wherein a fastener received in a bore of the base plate fixedly mounts the base plate to the mounting surface, the mounting surface defining a floor or a window sill.

3. The security device of claim 1, wherein the second direction is perpendicular to the first direction and the third direction is perpendicular to the first direction and the second direction.

4. The security device of claim 1, wherein the base plate and the stop member are fabricated from metal.

5. A device comprising:

a base plate having a to surface and a thickness extending in a first direction from the to surface, the base plate including a first opening and a second opening, the first opening and the second opening each extending partially into the thickness of the base plate from the to surface in the first direction, the first opening and the second opening being arranged end-to-end along a shared longitudinal axis extending in a second direction that is angularly oriented with respect to the first direction; and a stop member including a first leg and a second leg, the first leg extending in the first direction and having a first mating feature at a distal end thereof, the first mating feature including a first projection and a second projection, the first projection extending downwardly in the first direction and removably engaging the first opening of the base plate, the second projection extending downwardly in the first direction and removably engaging the second opening of the base plate simultaneously while the first projection removably engages the first opening of the base plate, the second leg defining a cantilever and extending in the second direction from a first proximal end of the first leg, a second distal end of the second leg extending beyond the base plate when the first projection removably engages the first opening and the second projection removably engages the second opening, the second distal end of the second leg configured to engage a sliding object and prevent the sliding object from moving along a third direction.

6. The device of claim 5, wherein a fastener received in a bore of the base plate fixedly mounts the base plate to a fixed surface, the fixed surface defining a floor or a window sill.

7. The device of claim 5, wherein the sliding object defines a sliding door or a sliding window.

8. The device of claim 5, wherein the second direction is perpendicular to the first direction and the third direction is perpendicular to the second direction and the first direction.

9. The device of claim 5, wherein the base plate and the stop member are fabricated from metal.

* * * * *